US005971602A

United States Patent [19]

Dorn

[11] Patent Number: 5,971,602

[45] Date of Patent: Oct. 26, 1999

[54] ECCENTRICALLY MOUNTED DRUM MIXER WITH INTERNAL MIXING DEVICES

[76] Inventor: Gordon J. Dorn, RR 1, Box 302, Denver, Iowa 50622

[21] Appl. No.: 09/179,060

[22] Filed: Oct. 26, 1998

[51] Int. Cl.[6] ..... B01F 9/08

[52] U.S. Cl. ..... 366/221; 366/224; 366/230

[58] Field of Search ..... 366/53–55, 62, 366/63, 92–96, 143, 219–225, 230–232

[56] References Cited

U.S. PATENT DOCUMENTS

| | | | |
|---|---|---|---|
| 42,129 | 3/1864 | True . | |
| 81,896 | 9/1868 | Haigh | 366/223 |
| 209,023 | 10/1878 | Coman . | |
| 366,591 | 7/1887 | Lundie . | |
| 581,687 | 5/1897 | Blundell . | |
| 849,540 | 4/1907 | Garred . | |
| 1,424,154 | 8/1922 | Clark . | |
| 1,755,763 | 4/1930 | Barber . | |
| 1,935,212 | 11/1933 | Levy et al. . | |
| 1,993,528 | 3/1935 | Roser | 366/92 |
| 2,108,502 | 2/1938 | Muench | 366/222 |
| 2,267,898 | 12/1941 | Cornell, Jr. | 366/225 |
| 2,543,279 | 2/1951 | Erwin . | |
| 2,816,371 | 12/1957 | Fischer | 366/224 |
| 2,868,519 | 1/1959 | Tocci . | |
| 3,086,332 | 4/1963 | Wentz . | |
| 3,090,604 | 5/1963 | Wheeler . | |
| 3,371,913 | 3/1968 | Muench, Sr. . | |
| 3,374,584 | 3/1968 | Haught . | |
| 3,380,671 | 4/1968 | Kubodera | 366/222 |
| 3,400,185 | 9/1968 | Kohnle et al. | 366/224 |
| 3,533,603 | 10/1970 | Kovacs . | |
| 3,946,996 | 3/1976 | Gergely | 366/224 |
| 4,183,678 | 1/1980 | Ohno | 366/224 |
| 4,235,553 | 11/1980 | Gall . | |
| 4,457,629 | 7/1984 | Liaw et al. | 366/143 |
| 5,556,202 | 9/1996 | Dorn | 366/220 |

FOREIGN PATENT DOCUMENTS

| | | | |
|---|---|---|---|
| 525618 | 9/1921 | France | 366/225 |
| 672020 | 3/1929 | France . | |
| 846387 | 11/1938 | France . | |
| 1062222 | 7/1959 | Germany | 366/224 |
| 2002621 | 11/1993 | Russian Federation | 366/224 |
| SU 1033171 | 8/1983 | U.S.S.R. . | |
| SU 1098558 | 6/1984 | U.S.S.R. . | |
| SU 1475702 | 4/1989 | U.S.S.R. . | |
| 122749 | 2/1919 | United Kingdom . | |
| 97/02089 | 1/1997 | WIPO | 366/224 |

*Primary Examiner*—Charles E. Cooley
*Attorney, Agent, or Firm*—James C. Nemmers

[57] ABSTRACT

A drum-type mixer having a cylindrical-shaped drum mounted eccentrically on a drive shaft that rotates the drum. A second shaft, concentric with the drive shaft, extends inside of the drum and is operatively connected to mixing devices, such as scrapers, paddles, etc. to aid in the mixing process. The mixing devices can be rotated the same direction or in the opposite direction as the rotational direction of the drum itself, and the drum and mixing devices can be driven at the same or different speeds. Also, the shaft that extends to the interior of the drum can be used to inject fluids, such as steam, into the product mix and can also be used to exhaust fluids from the interior of the drum.

7 Claims, 6 Drawing Sheets

ECCENTRICALLY MOUNTED DRUM MIXER WITH INTERNAL MIXING DEVICES

BACKGROUND OF THE INVENTION

Mixers are widely used for mixing a variety of both wet and dry products. There are mixers that are employed in continuous mixing systems and there are batch type mixers in which the products to be mixed are placed in the mixer and then agitated. There are numerous batch-type mixers known and used, many of which are designed to mix a specific type of product. Depending upon the type of product, these mixers employ a variety of agitators, paddles, scrapers, wipers, etc. that perform the mixing operation. In addition, there are drum-type mixers in which the drum is revolved while stationary baffles inside of the drum provide the necessary agitation to mix the product. A number of these drum-type mixers include a drum that is eccentrically mounted on an axis so that when the drum is rotated, the material will be moved from one end of the drum to the other as well as from top to bottom in a somewhat figure 8 pattern. An example of a mixer of this type is shown in Dorn U.S. Pat. No. 5,556,202 in which the shaft upon which the mixer revolves is eccentrically mounted relative to the axis of the drum and does not extend through the drum, the drum being mounted on a subframe that permits the drum to be tilted for ease of filing and unloading.

With the increasing number of applications for mixers that can effectively mix a variety of products, both wet and dry, and with user demands that mixers be easily cleaned in place, there is a need for an improved mixer that will effectively mix a variety of both wet and dry products, and one that is simple and relatively inexpensive while still being easy to clean.

It is therefore an object of this invention to provide a mixer of the eccentrically mounted drum-type which has improved mixing action for both wet and dry products and which can be easily cleaned in place.

SUMMARY OF THE INVENTION

The drum-type mixer of the invention utilizes a cylindrical-shaped drum mounted eccentrically on a drive shaft that rotates the drum. A second shaft, concentric with the drive shaft, extends inside of the drum and is operatively connected to mixing devices, such as scrapers, paddles, etc. to aid in the mixing process. The mixing devices can be rotated the same direction or in the opposite direction as the rotational direction of the drum itself, and the drum and mixing devices can be driven at different speeds. If desired, the shaft that extends to the interior of the drum can be used to inject fluids, such as steam, into the product mix and can also be used to exhaust fluids from the interior of the drum. With flexible wipers attached to the shaft extending inside of the drum, the drum can be cleaned in place as cleaning fluid is injected and then exhausted through the manifold provided by the interior shaft.

DESCRIPTION OF THE PREFERRED EMBODIMENTS OF THE INVENTION

Figure 1:
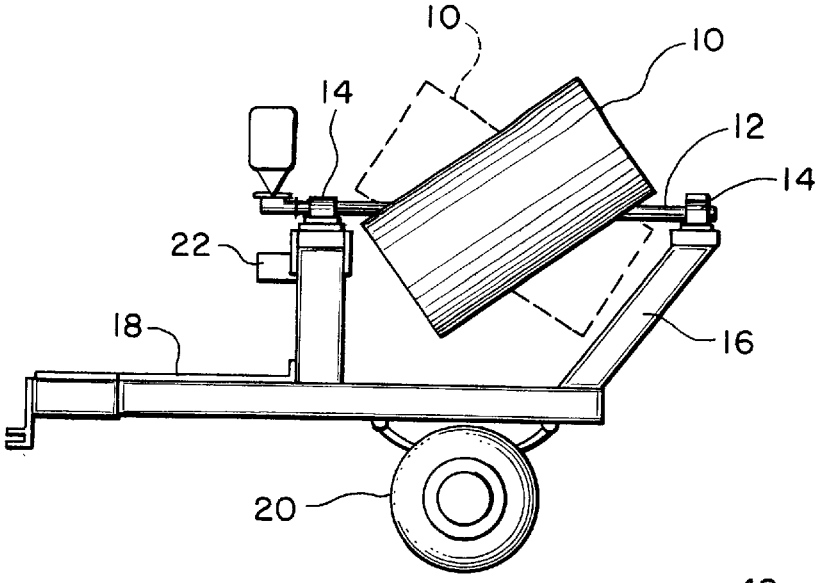
FIG. 1 is a side elevational view of a mixer constructed according to the invention and showing the mixer mounted on wheels for portability.
Figure 2:
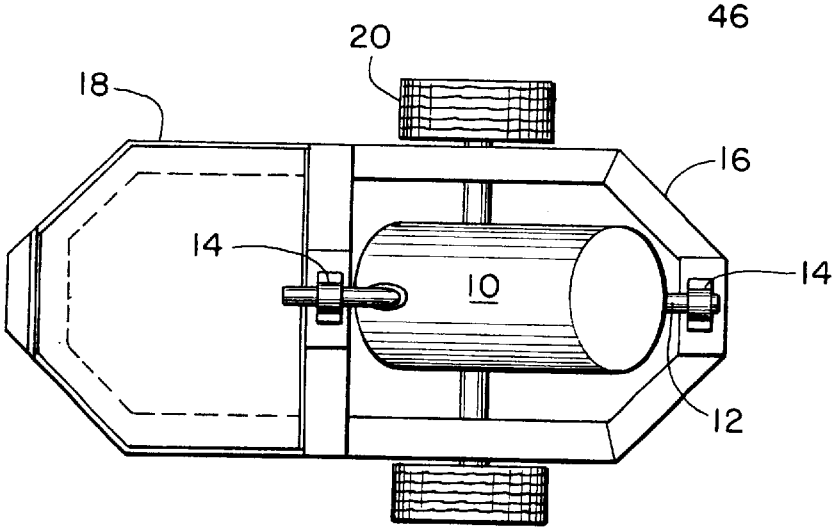
FIG. 2 is a top or plan view of the mixer of FIG. 1.

Referring first to FIGS. 1 and 2, there is illustrated a drum-type mixer that is mounted for portability. The mixer includes a cylindrical-shaped drum 10 eccentrically mounted on a drive shaft 12 that is rotatable in bearings 14 mounted on a supporting frame 16. If it is desired to have the mixer portable, the supporting frame 16 is mounted on a chassis 18 supported by ground engaging wheels 20. The drive shaft 12 can be either manually driven or driven by a suitable hydraulic motor 22 that has a suitable control so that the speed of the motor and thus the speed of shaft 12 can be varied.

Figure 3:
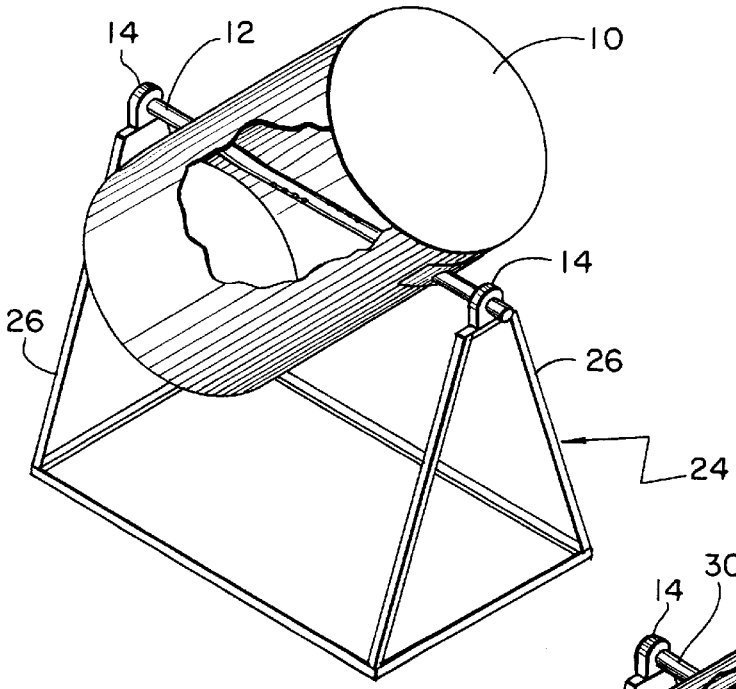
FIG. 3 is a perspective view of the drum and supporting frame with a portion of the drum broken away to show the interior shaft.

FIGS. 3 through 7 are simplified drawings that illustrate the principles of the invention in its various embodiments. Referring first to FIG. 3, a supporting frame 24 has two end supports 26 that provide an open space between them so that the drum 10 can freely rotate between the end supports 26. In FIG. 3, a single drive shaft 12 is shown, the drive shaft 12 extending through the interior of the drum 10. The drive shaft 12 of the embodiment of FIG. 3 is a hollow tube containing a plurality of openings 28 so that fluid can be introduced through shaft 12 and discharged through openings 28 into the interior of drum 10. Openings 28 can also be used to discharge fluid from the interior of the drum. Suitable components for introducing and discharging fluid from the interior of the drum 10 are well known to those skilled in the art. The ability of this embodiment of the invention to introduce fluid into the drum is useful in certain applications where liquid or steam is introduced for mixing with a product or for cleaning the drum in place. In the embodiment of FIG. 3, there are no interior baffles, the mixing action taking place by reason of the eccentric mounting of the drum on the drive shaft 12. For effective mixing, the angle between the axis of drive shaft 12 and the longitudinal axis through the cylindrical drum 10 should be in the range of 28° to 58°.

Figure 4:
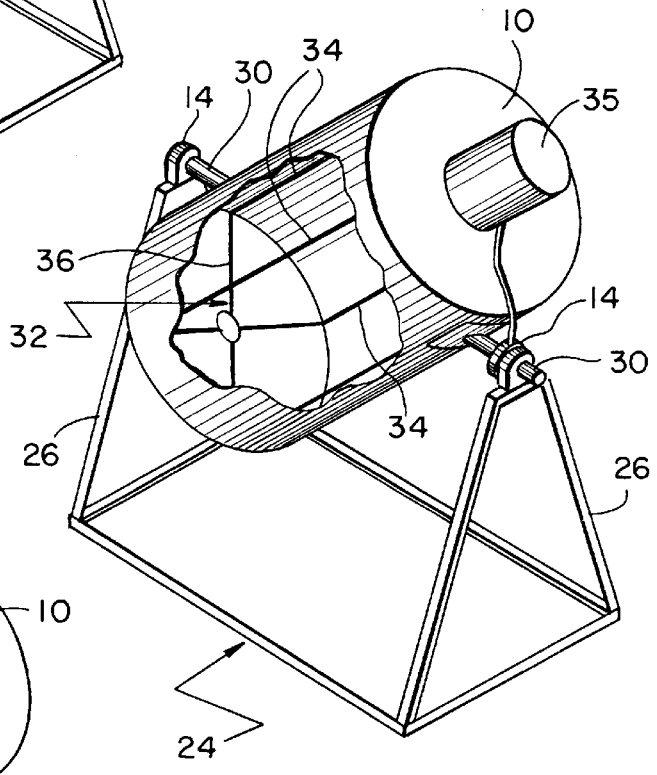
FIG. 4 is a perspective view of the drum and supporting framework with a portion of the drum broken away to show the interior mixing device.

In FIG. 4, the drum 10 is mounted on a drive shaft 12 that does not extend through the interior of the drum 10. The drive shaft 12 consists of stub shafts 30 which are welded or otherwise suitably secured to the exterior of the cylindrical surface of drum 10, the shafts 30 being mounted in suitable bearings 14 on the supporting frame 24. In the embodiment of FIG. 4, a rectangular-shaped mixing bar 32 is mounted inside of the drum 10, the mixing bar 32 having longitudinally extending portions 34 with transverse portions 36 mounted close to the ends of the drum 10. The mixing bar 32 can be driven in any suitable manner, such as by a hydraulic motor 35 which will rotate the mixing bar 32 within the drum 10 usually in a direction of rotation opposite to that of the direction of rotation of the drum 10. The mixing bar 32 can function to mix and scrape the material in the drum 10 or used to clean the inside surface of drum 10. Mixing bar 32 can be driven at any desired speed in either direction and is capable of use in a self-cleaning or clean in place system.

Figure 8:
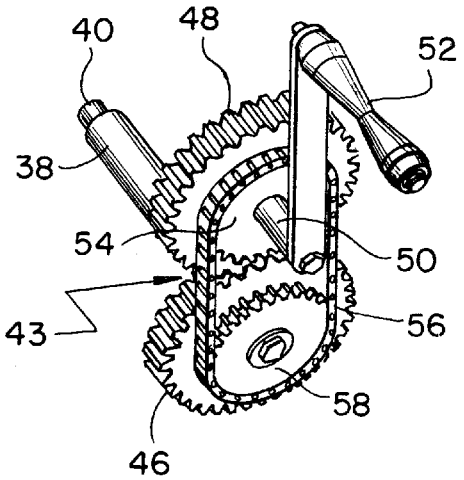
FIG. 8 is a perspective view of a gear train that can be used in driving the multiple shafts of the mixer.
Figure 5:
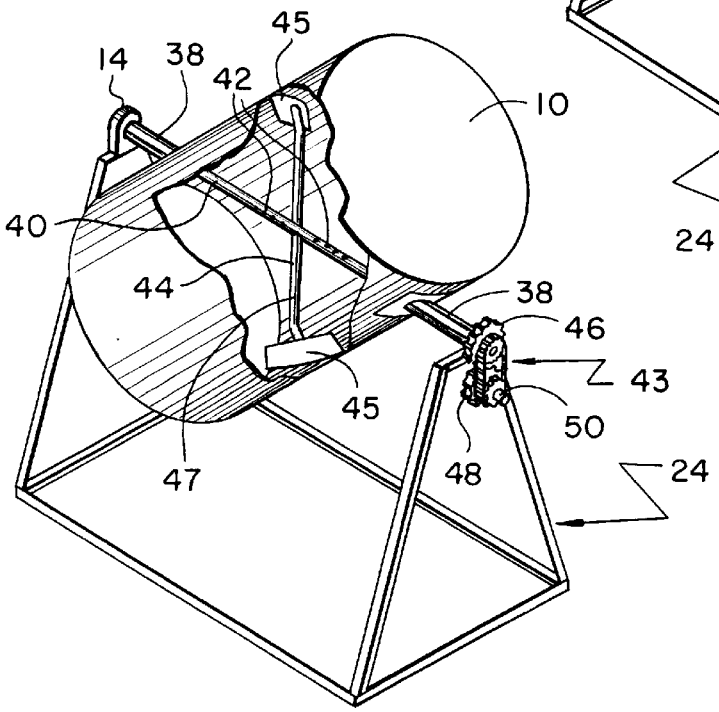
FIG. 5 is a perspective view of a drum and supporting framework with a portion of the drum broken away to show the interior mixing device and drive for a multiple shaft arrangement.

FIG. 5 illustrates an embodiment of the invention in which the drum 10 is mounted on hollow stub shafts 38 rotatable in bearings 14 on a supporting framework 24. Rotatably mounted within the stub shafts 38 is a manifold shaft 40 that extends through the interior of the drum 10. Shaft 40 contains a plurality of openings 42 to provide for the injection and discharge of fluids into the interior of the drum. A mixing paddle 44 is secured to the shaft 40 and rotatable with it, there being a paddle 45 on each end of a shaft 47 that is spaced from the inside surface of drum 10. The mixing paddle 44 can be driven a any desired speed, and at high speeds is effective to blend or liquefy products. In the embodiment of FIG. 5, a drive gear arrangement 43 is illustrated which provides for rotation of the stub shafts 38 (and thus the drum 10) in a rotational direction opposite to that of the manifold shaft 40. If desired, an independent drive may be mounted at the end of the mixer opposite drive gear 43 so that one can serve as a low speed drive while the other serves as a high speed drive. A typical gear arrangement 43 is shown in detail in FIG. 8 and includes a first spur gear 46 affixed to the stub shaft 38 so as to drive shaft 38. Spur gear 46 is engaged with a second spur gear 48 that is rotatable about shaft 50 to which a crank 52 is attached so that the gears can be manually driven. If desired, shaft 50 can be power driven. Affixed to and rotatable with the spur gear 48 is pinion 54 which through chain 56 drives a second pinion 58 that is operatively connected to and drives manifold shaft 40. With this gear train arrangement, manifold shaft 40 is driven in a rotational direction opposite to that of the stub shafts 38, thus driving the mixing paddle 44 in a direction opposite to the direction of rotation of drum 10. Also, depending upon the design of the gear train, relative speeds of the manifold shaft 40 and stub shafts 38, and thus the relative speeds of the mixing paddle 44 and drum 10, can be controlled.

Figure 6:
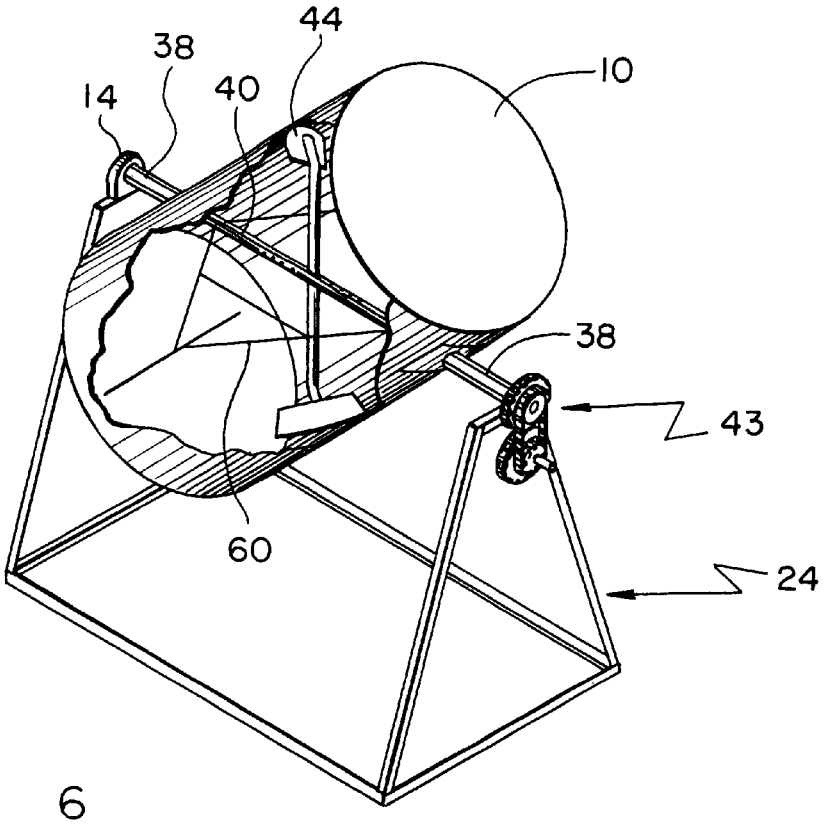
FIG. 6 is a perspective view of a drum and supporting framework with a portion of the drum broken away to show the construction of the interior mixing devices.

In FIG. 6 there is illustrated yet another embodiment of the invention. This embodiment of FIG. 6 is similar to the embodiment of FIG. 5 except that in addition to the mixing paddle 44 a mixing bar 60 is attached to the manifold shaft 40. In some applications, the addition of the mixing bar 60 provides specific mixing action for certain products.

Figure 7:
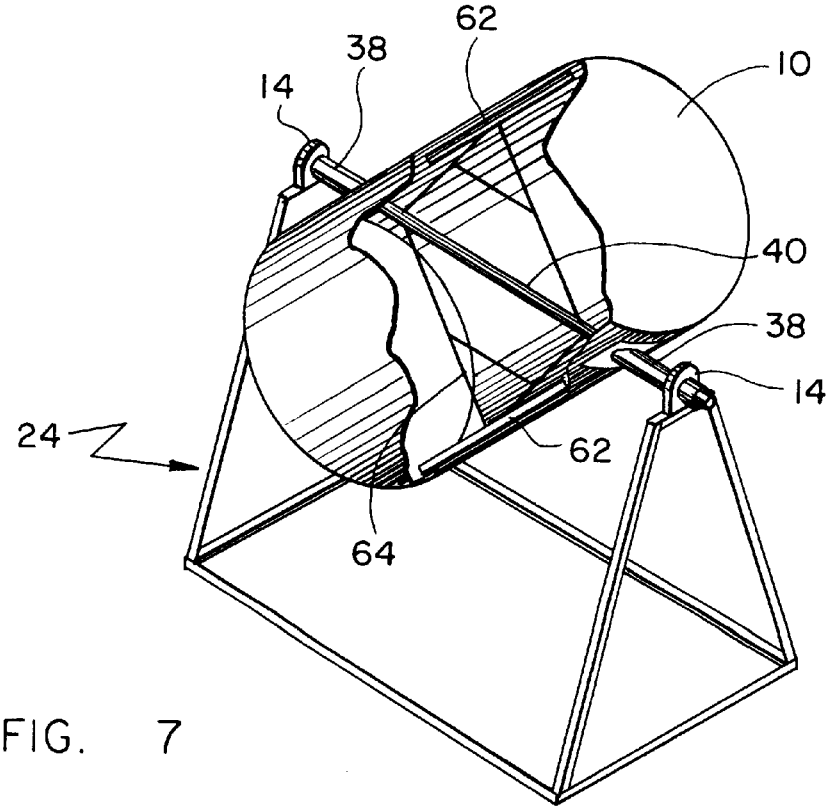
FIG. 7 is a perspective view of a drum and supporting framework with a portion of the drum broken away to show the configuration of another type of mixing device.

Referring now to FIG. 7 there is shown yet another embodiment of the invention which embodiment is similar to the embodiment of FIG. 5 except for the mixing devices attached to the manifold shaft 40. In the embodiment of FIG. 7, the mixing paddle 44 is replaced by scrapers 62 mounted on supporting bars 64 affixed to the manifold shaft 40 which in the embodiment of FIG. 7 is stationary.

Figure 9:
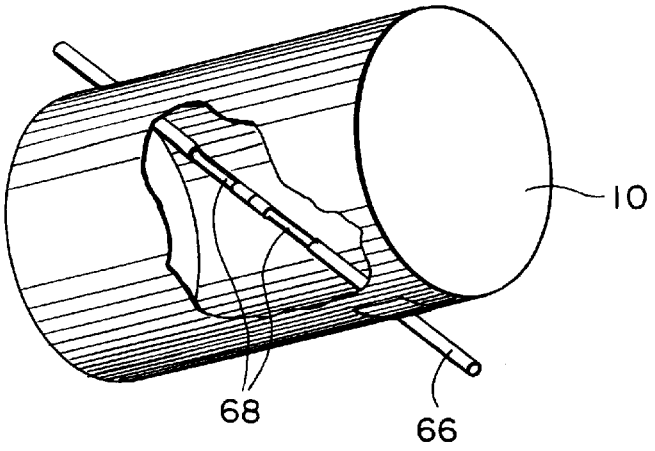
FIG. 9 is a perspective view of a drum with a portion of the drum broken away to show the internal manifold arrangement.
Figure 11:
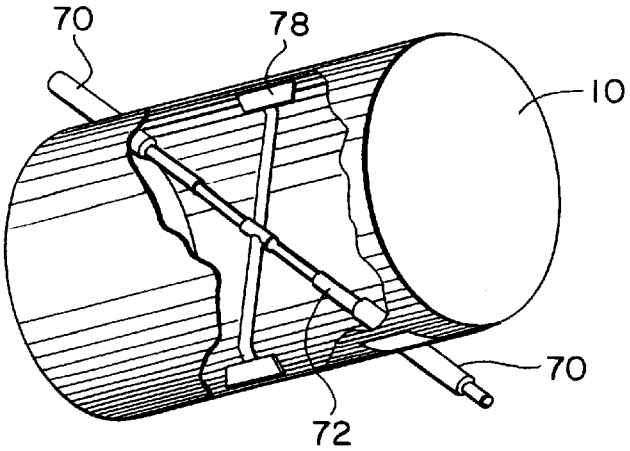
FIG. 11 is a perspective view of a drum similar to FIGS. 9 and 10 with a portion of the drum broken away to show a combination manifold and mixing device arrangement.
Figure 12:
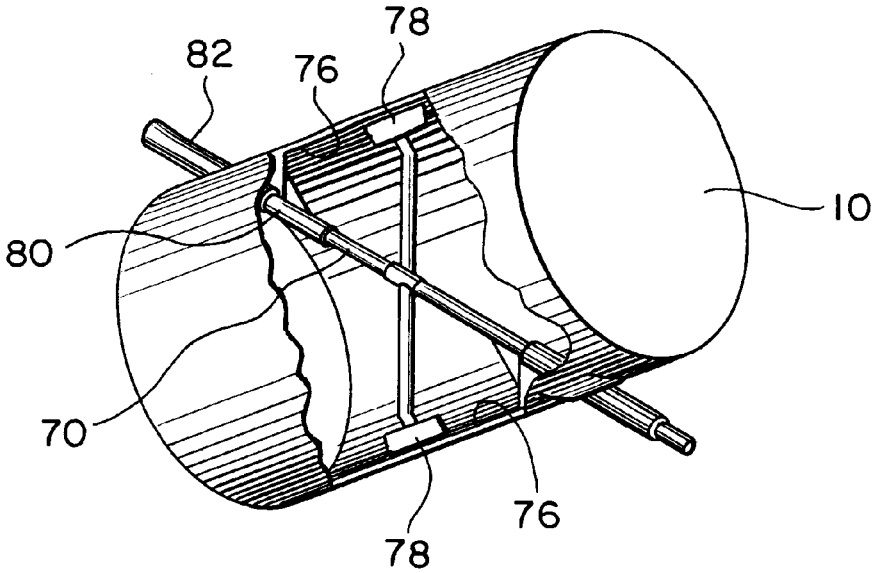
FIG. 12 is a perspective view of a drum with a portion of the drum broken away to show another version of a manifold and mixing device arrangement as further illustrated in FIG. 16.
Figure 13:
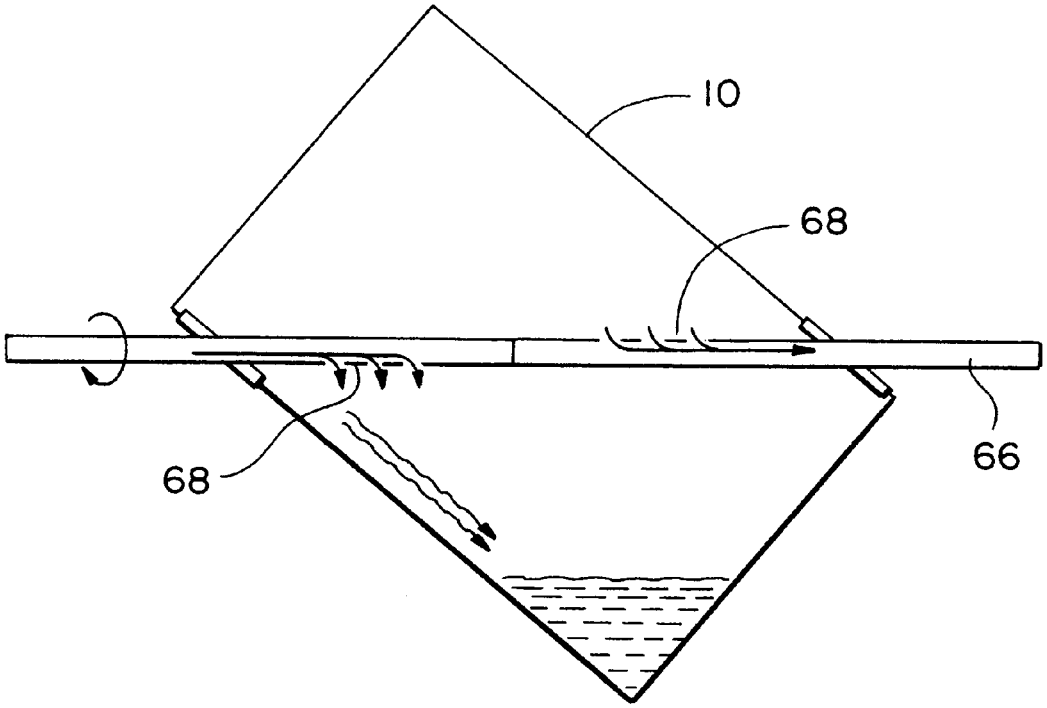
FIG. 13 is a side elevational view schematically showing the manifold arrangement of the drum of FIG. 9.

In FIGS. 9 through 16, there are shown further details of the embodiments already described and variations on those embodiments. FIGS. 9 and 13 illustrate a drum 10 having a single shaft 66 that is affixed to the drum 10 and extends completely through its interior. Shaft 66 thus drives the drum 10 and contains slots or openings 68 for the introduction or discharge of fluid.

Figure 10:
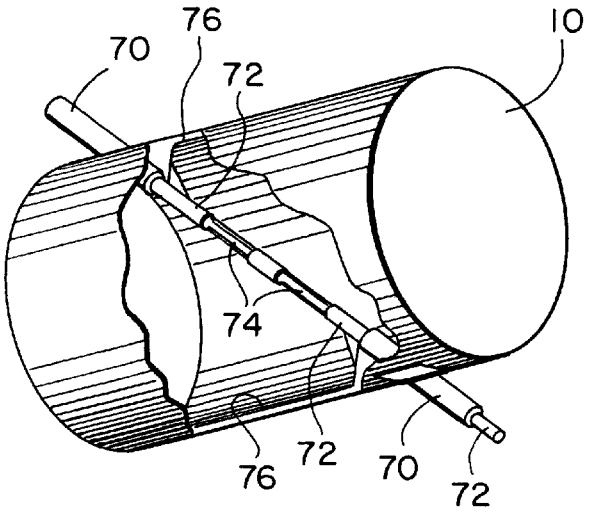
FIG. 10 is a perspective view similar to FIG. 9 with a portion of the drum broken away to show another embodiment of the manifold.
Figure 15:
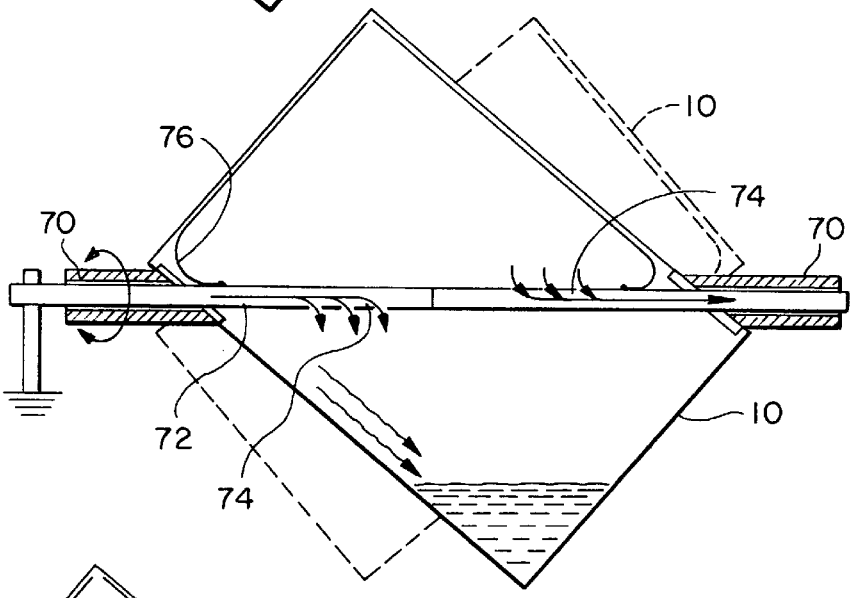
FIG. 15 is a side view schematically showing a drum with a manifold and wiper arrangement as further illustrated in FIG. 10.

In FIGS. 10 and 15, the drum 10 has stub drive shafts 70 which are affixed to and which drive the drum 10 and inside of which extends a stationary manifold shaft 72. Shaft 72 contains openings or slots 74 for the introduction or discharge of material. FIGS. 10 and 15 also illustrate flexible wipers 76 attached to the stationary manifold shaft 72 so that as drum 10 rotates, the interior surfaces of the drum are wiped clean. This particular embodiment is especially useful where a product is being moistened and mixed so that the interior surfaces of the drum 10 are scraped clean during the mixing of the product. This also assures discharge of all of the product from the drum 10.

Figure 14:
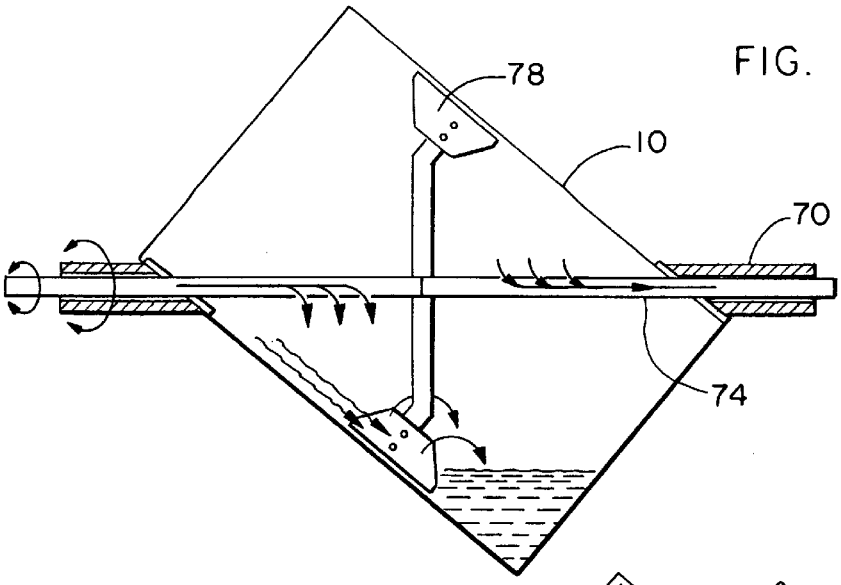
FIG. 14 is a side view schematically showing the manifold and mixing device arrangement of the drum of FIG. 11.

FIGS. 11 and 14 illustrate an embodiment similar to that of FIGS. 10 and 15 except that in place of the wipers 76 there is a mixing paddle 78. Otherwise, the embodiment of FIGS. 11 and 14 is identical to that of FIGS. 10 and 15 and include stub drive shafts 70 with a manifold shaft 72 that may either be stationary or rotatable depending upon the mixing action desired.

Figure 16:
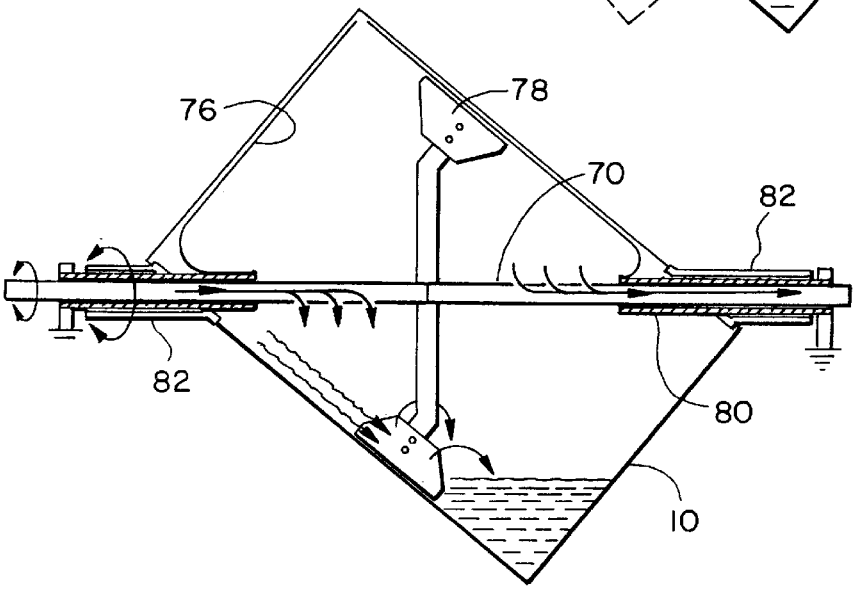
FIG. 16 is a side view schematically showing a drum with a combination manifold, mixing paddle and wiper arrangement as illustrated in FIG. 12.

In the embodiments of FIGS. 12 and 16, the drum 10 contains both a mixing paddle 78 affixed to a rotatable manifold shaft 70, and a flexible wiper 76 affixed to a stationary shaft 80 that extends inside of the rotatable stub shafts 82. Thus, the embodiment of FIGS. 12 and 16 provides for maximum mixing action by reason of the mixing paddle 78 which can be driven in either the same direction as the rotation of drum 10 or in the opposite direction and at the same or a different speed. In addition, the flexible wipers 76 are held stationary. The manifold shaft 72 also provides for the introduction and discharge of fluids into the interior of the drum.

Although not shown in the drawings, suitable openings in the drum obviously are provided for the introduction and discharge of product. These openings can be in the form of removable ends on the cylindrical drums or in the form of openings in any portion of the drum, which openings can be easily opened and closed and locked in place when closed.

Operation of the various mixers shown in the embodiments of the invention should be evident from the foregoing descriptions. Using a basic design of an eccentrically mounted drum and one or more shafts, the invention provides for different mixing actions depending on the particular product application. By providing multiple shafts that can be rotated in different directions and at different speeds, vigorous and complete mixing of products can be obtained. Where it is desirable to introduce fluids into the mixing operation, the manifold shaft provides an efficient but simple way of both introducing and discharging fluids. Flexible wipers can be provided to assure that the interior surfaces of the drum are wiped clean during the mixing operation for complete mixing and also to assure that all of the mixed product will be discharged from the drum. The invention provides a mixer that is extremely simple in design, having a minimum of components and a minimum of moveable components. This makes the mixer easier to clean, and with the embodiments containing the manifold shafts, the drums can be cleaned in place. In none of the embodiments is anything internally attached to the drum which simplifies the manufacturing process for the apparatus. Also, if desired, the drum can be made of transparent material, such as dear plastic, so that the mixing action taking place inside the drum can be observed.

The invention in its various embodiments provides maximum flexibility for mixing of products in virtually any application, whether the products are wet or dry. The features described and claimed herein can be combined with the features of my prior U.S. Pat. No. 5,556,202 to make a complete line of mixers for virtually any application.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A drum-type mixer for mixing and processing two or more materials, said mixer comprising: a supporting frame for supporting the mixer, a cylindrical-shaped drum having a cylindrical shaped main body with an inner surface and opposite circular ends joined to the main body to provide an enclosed drum, the drum having a longitudinal axis extending between the centers of the circular ends, a first shaft for eccentrically mounting the drum on the supporting frame for rotatable movement about an axis of rotation that is at an angle to the longitudinal axis of the drum, a second shaft inside of the drum to provide for additional processing of the materials in the drum, the second shaft providing a longitudinal passageway capable of carrying fluid into the drum from outside the drum, a wiper extending outwardly from the second shaft to engage the inner surface of the drum thereby providing for cleaning of the interior of the drum, and first drive means combined with the first shaft to provide for rotation of the drum about the axis of rotation.

2. The drum type mixer of claim 1 in which the second shaft is stationary and the wiper is adapted to engage the opposite circular ends of the drum.

3. The drum type mixer of claim 1 in which the second shaft is concentric with the first shaft and second drive means is operatively connected to the second shaft to rotate the second shaft independently of the first shaft, and the wiper is adapted to engage the cylindrical shaped main body of the drum.

4. A drum-type mixer for mixing and processing two or more materials, said mixer comprising: a supporting frame for supporting the mixer, a cylindrical-shaped drum having a cylindrical shaped main body with an inner surface and opposite circular ends joined to the main body to provide an enclosed drum, the drum having a longitudinal axis extending between the centers of the circular ends, a first shaft for eccentrically mounting the drum on the supporting frame for rotatable movement about an axis of rotation that is at an angle to the longitudinal axis of the drum, a second shaft inside of the drum and concentric with the first shaft to provide for additional processing of the materials in the drum, a scraper extending outwardly from the second shaft to engage the inner surface of the drum, first drive means combined with the first shaft to provide for rotation of the drum about the axis of rotation, and second drive means is operatively connected to the second shaft to rotate the second shaft independently of the first shaft.

5. The drum type mixer of claim 4 in which there is a non-rotatable third shaft concentric with the first and second shafts, and a wiper extends outwardly from the third shaft and is adapted to engage the opposite circular ends of the drum.

6. The drum type mixer of claim 5 in which the scraper extending outwardly from the second shaft is adapted to engage the cylindrical shaped main body of the drum.

7. The drum type mixer of claim 6 in which the second shaft provides a longitudinal passageway capable of carrying fluid into the drum from outside the drum.

* * * * *